United States Patent [19]

Hashio et al.

[11] 4,077,457

[45] Mar. 7, 1978

[54] MOLTEN METAL POURING CONTROL METHOD AND APPARATUS FOR USE IN CONTINUOUS CASTING EQUIPMENT

[75] Inventors: Moriki Hashio, Kashima; Toshio Terashima, Osaka, both of Japan

[73] Assignees: Sumitomo Metal Industries Limited, Osaka; Sumitomo Shipbuilding and Machinery Co. Ltd., Tokyo, Japan

[21] Appl. No.: 599,682

[22] Filed: Jul. 28, 1975

Related U.S. Application Data

[63] Continuation of Ser. No. 448,712, Mar. 6, 1974, abandoned.

[51] Int. Cl.[2] ..... B22D 11/10

[52] U.S. Cl. ..... 164/4; 164/155

[58] Field of Search ..... 164/4, 155, 156, 281, 164/154; 222/561

[56] References Cited

U.S. PATENT DOCUMENTS

| | | | |
|---|---|---|---|
| 3,536,124 | 10/1970 | Hanas et al. | 164/155 |
| 3,866,806 | 2/1975 | Shapland | 222/561 X |

FOREIGN PATENT DOCUMENTS

| | | | |
|---|---|---|---|
| 22,255 | 9/1970 | Japan | 164/154 |

*Primary Examiner*—Robert D. Baldwin

*Attorney, Agent, or Firm*—Watson, Cole, Grindle & Watson

[57] ABSTRACT

The pouring of molten metal from a tundish to a mold in a continuous casting process is controlled by regulating the variable opening of a tundish nozzle. The level of the molten metal in the mold is measured and compared with a desired preset level and the nozzle opening is varied in accordance with the difference between the measured level of the metal and the preset level in the mold. The nozzle opening is detected and an electrical signal representative thereof is provided to the input of a servo amplifier along with the difference between the measured level of the molten metal and the preset level in the mold to provide a control signal for varying the opening of the nozzle in the tundish. A component of the electrical signal representing a desired minimum opening of the nozzle opening to prevent the full closing thereof is also provided. Different openings of the nozzle in the tundish with respect to the stroke of the piston of a servo cylinder for actuating the nozzle opening are attained by a switch which modifies the electrical signal.

6 Claims, 6 Drawing Figures

MOLTEN METAL POURING CONTROL METHOD AND APPARATUS FOR USE IN CONTINUOUS CASTING EQUIPMENT

This a continuation application Ser. No. 448,712 filed Mar. 6, 1974, now abandoned.

The present invention relates to molten metal pouring control method and apparatus in which continuous molten metal pouring from a tundish into mold in a continuous casting equipment is controlled by means of a sliding nozzle.

Unlike the usual non-continuous steel making process, the continuous casting process is considerably automated; however, only a small part of the molten metal pouring process thereof has heretofore been automated. With respect to controlling the level of the molten metal in the mold of a large-scale slab continuous casting equipment, the input pouring rate is controlled by means of a stopper attached to the tundish, and the output flow rate is controlled in accordance with the rotation rate of the pinch roll.

As for controlling only the output flow rate it can be controlled by a process whereby the level of the molten metal in the mold is detected by gamma rays using cobalt 60 or similar means, and the signal thereof is fed back to change the rotation rate of the pinch roll. This method is already partially used in the molten metal pouring process. The disadvantage with such a method is that although the desired level of the molten metal can be maintained, the pouring rate changes, resulting in bad quality of the produced slab.

In order to maintain the level of the molten steel in the mold while keeping the pouring rate as constant as possible, it is necessary to control the pouring rate of the molten steel from the tundish. However, this method is very difficult with use of the conventional stopper means because the relationship between the stopper nozzle diameter and stroke is so complicated that it has not yet even been theoretically explained. Further, an effective measure has not yet been taken in the case where it is required to change the nozzle diameter in the course of the pouring operation.

It is an object of the present invention to provide an improved method and apparatus for maintaining the molten steel in the mold at a constant level while keeping the molten steel pouring rate constant, thereby improving the quality of the cast slab, bloom, or billet.

It is another object of the present invention to provide a method and apparatus in which the tundish is provided with a sliding nozzle, a part of the stroke of which is used for controlling the opening of a nozzle as the full control range.

It is another object of the present invention to provide a method and apparatus in which a desired nozzle diameter can be selected and attached to the tundish.

It is another object of the present invention to provide a method and apparatus to which a limit circuit is provided on the closing-direction stroke side of the sliding nozzle to prevent the nozzle from being fully closed, thereby preventing clogging of the nozzle.

These and other objects of the invention will be more clearly understood from the following description and the accompanying drawings.

DESCRIPTION OF THE PREFERED EMBODIMENT

Figure 1:
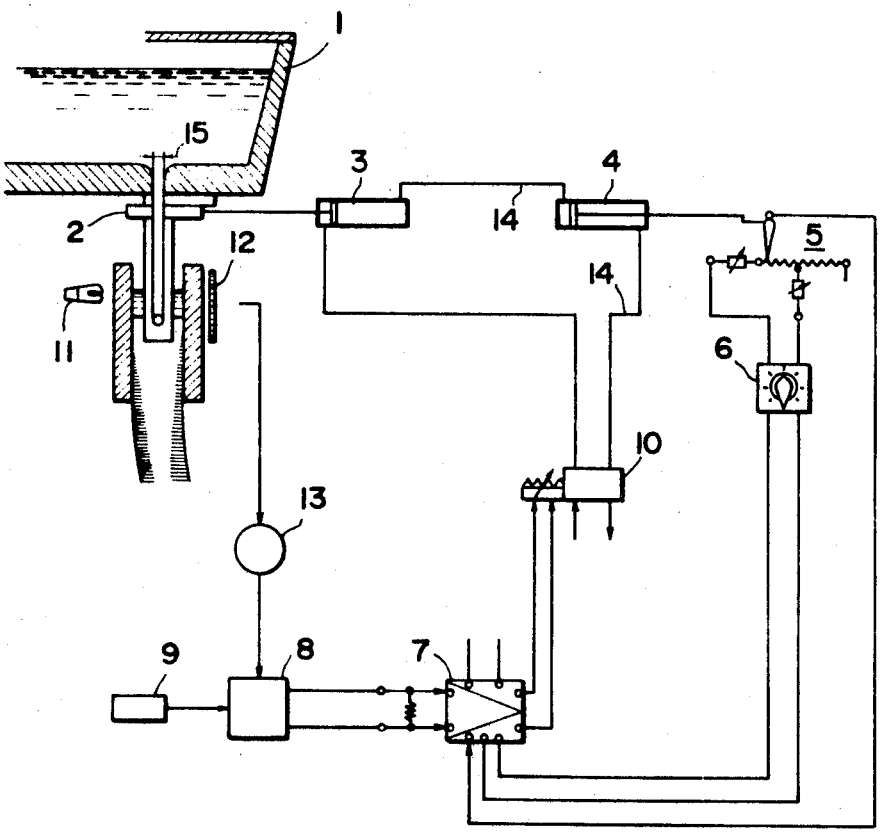
FIG. 1 is a schematic diagram illustrating a control circuit of a preferred embodiment of the present invention.
Figure 2:
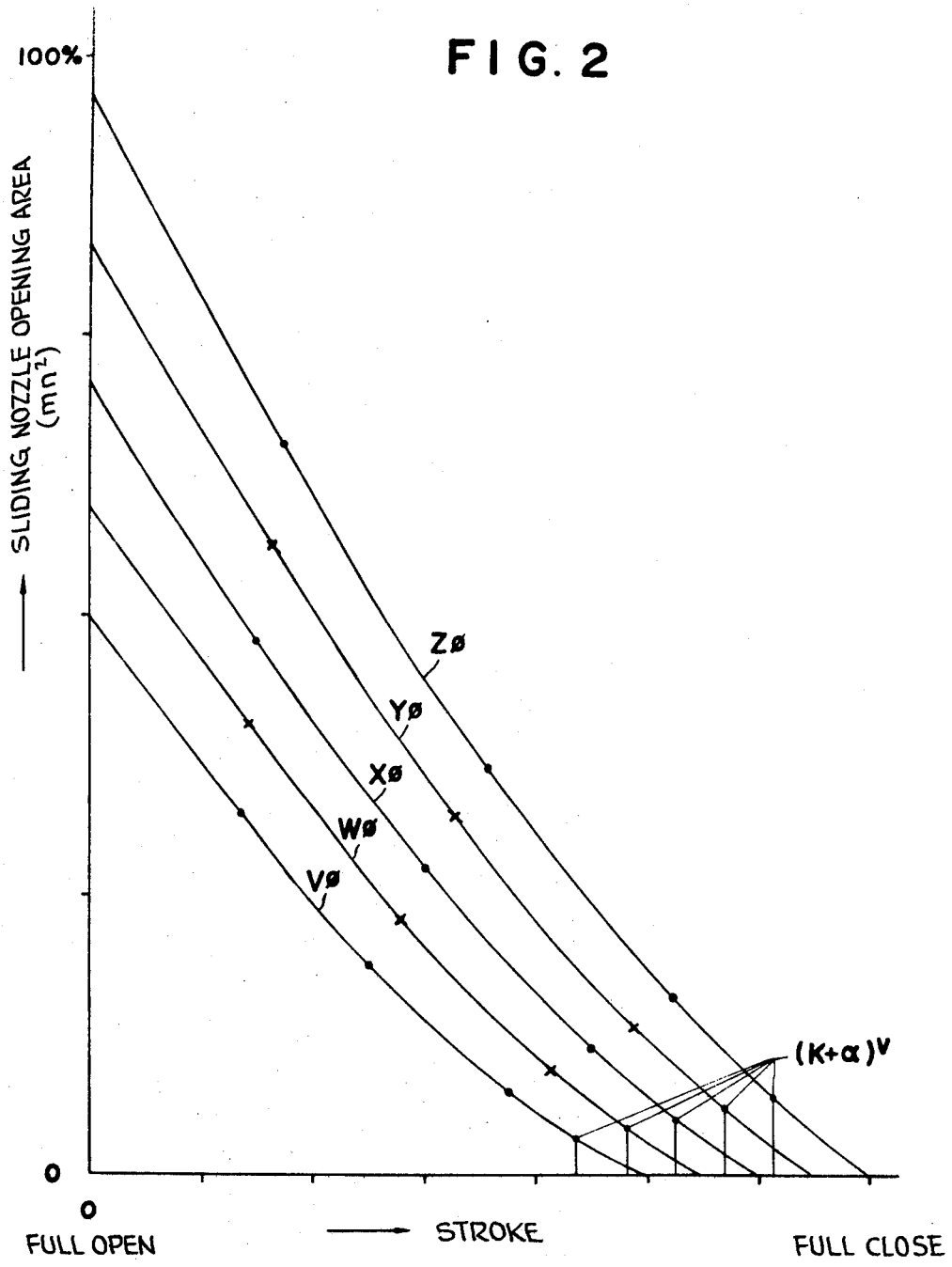
FIG. 2 is a graph showing the relationship between the nozzle opening area and the nozzle stroke with the nozzle diameter taken as parameter.

As shown in FIG. 1, sliding nozzle 2 is on mounted tundish 1. It is well known that the opening area of the sliding nozzle 2 can be designed so as to be approximately proportional to the nozzle stroke, as shown in FIG. 2. Therefore, the outflow discharge from tundish 1 can be theoretically controlled relative to the molten steel level in the mold.

As shown in FIG. 2, the change of the sliding nozzle opening area curves with respect to the nozzle stroke are specifically preset by selecting the full opening area to desired values as denoted by curves V$\phi$, W$\phi$, X$\phi$, Y$\phi$, and Z$\phi$ in FIG. 2.

Figures 5A, 5B:
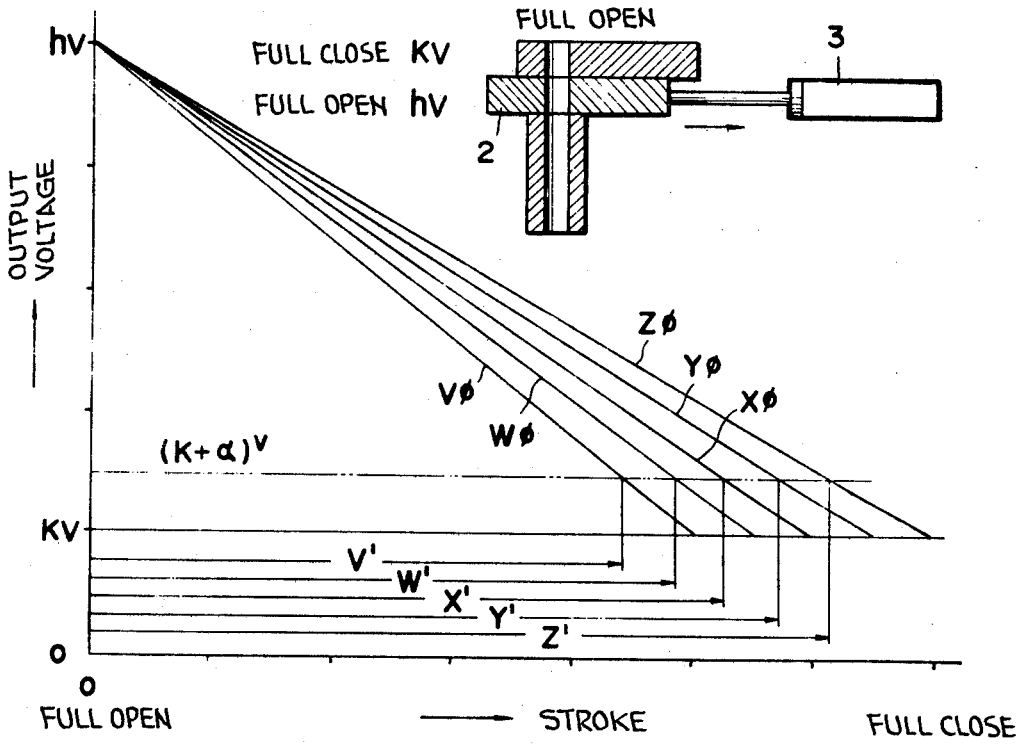
FIG. 5*a* is a graph showing the relationship between the nozzle stroke and the potentiometer output voltage which represents the nozzle opening, with the nozzle diameter taken as parameter.
FIG. 5*b* is an enlarged sectional view of a sliding nozzle.

Referring to FIG. 1 and FIG. 5*b*, the slider 2 of the sliding nozzle is mechanically coupled through a connecting rod with a work cylinder 3, and is operated in the range between a fully open position and a fully closed position by hydraulic pressure applied by a servo valve 10 through a pipe 14. The hydraulic pipe 14 is connected in series or parallel with a servo cylinder 4 to which the required opening of the sliding element of the sliding nozzle 2 is precisely transmitted. The servo cylinder 4 is in turn connected to a potentiometer 5 which converts the required opening of the sliding nozzle into an electrical signal.

Figure 3:
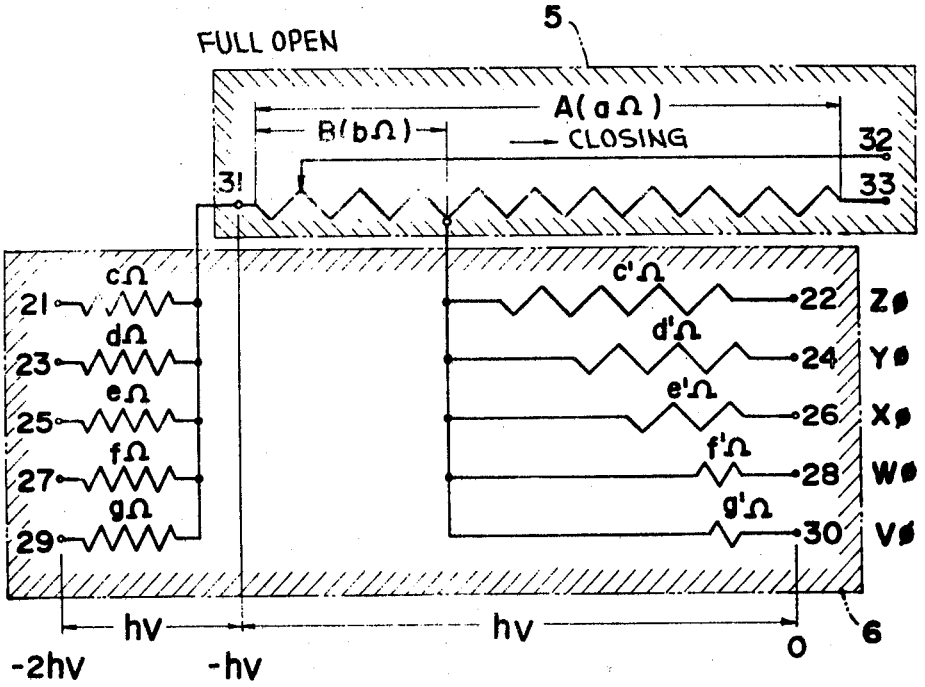
FIG. 3 is a circuit diagram of a potentiometer.
Figure 4:
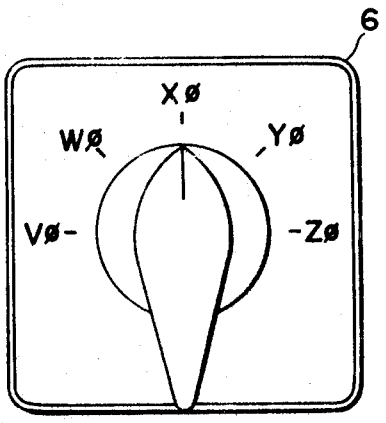
FIG. 4 is a front view of a nozzle diameter selector switch.

The potentiometer 5, as schematically shown in FIG. 3, uses terminal 31 as reference and has at both sides thereof two sets of resistors *g, f, e, d,* and *c* and *g', f', e', d',* and *c'*, which correspond to the nozzle diameters V, W, X, Y, and Z, respectively. Corresponding terminals 21 and 22, 23 and 24, 25 and 26, 27 and 28, and 29 and 30 are connected to a nozzle diameter selector switch 6 shown in FIG. 1 and FIG. 4. The selector switch 6 is capable of selecting the desired nozzle diameter. The potentiometer 5 has a potentiometer resistor connected between terminals 31 and 33, on which a wiping contact is connected to terminal 32 and which slides so as to follow the opening motion of the servo cylinder 4, thereby providing an electrical signal corresponding to the opening of the work cylinder 3. Accordingly, it can be seen from the circuit connection described above that the voltage generated in accordance with the change of the stroke of the work cylinder 3 is maintained at a constant value *h* (volts) with full opening of the sliding nozzle 2 and to another constant value *k* (volts) upon full closure thereof, as illustrated in FIG. 5A. The full closing of the sliding nozzle 2 is not desirable for a continuous casting operation because a characteristic of the sliding nozzle 2 causes clogging of the nozzle. Therefore, it is necessary to provide a proper limit circuit that functions to limit the output voltage decrease to a certain value, for example, $k + \Delta$ before the nozzle reaches a fully closed condition, that is, to prevent the sliding nozzle 2 from being fully closed during the automatic control operation. The function of the limit circuit can be provided such that a certain voltage is applied to the potentiometer circuit, or more simply by a small limit switch which is mounted to the wiping contact of the potentiometer or the servo cylinder. It can be seen that the stroke control range of the nozzle diameter is largely extended from V' to Z' as shown in FIG. 5*a*.

The voltage signal output from the potentiometer 5 is a feedback signal for the nozzle opening to the input of a servo amplifier 7 shown in FIG. 1 to balance with a signal from a controller 8. If both the signals are unbalanced, a servo valve 10 operates to control the nozzle opening.

To detect the level of the molten metal in the mold, the continuous casting equipment is equipped with a gamma-ray source 11 containing cobalt 60 or similar elements and a scintillator 12, the detected input of which is converted to an electric signal which is indicated or recorded on a molten metal indicator 13. The converted output signal is compared with the reference value preset by a setting means 9. The difference between the signal is input to the servo amplifier 7, wherein the input signal is compared with the feedback signal in accordance with the nozzle opening, thereby operating the servo valve 10, as described previously. The above-described circuits comprise the entire control for the molten metal pouring system for the continuous casting equipment. In FIG. 1, the nozzle diameter is indicated by number 15.

An advantage of the embodiment of the present invention is that the amount of the outflow discharge can be properly controlled according to the nozzle diameter. Another advantage with the embodiment is that the control operation is accurate since the nozzle diameter and the feedback signal are made to directly correspond to each other at any time. Accordingly, the response characteristic of the entire control system is so precise that it can quickly follow a change of the continuous casting operation. In addition, the sliding stopper portion does not cause a large molten loss in the nozzle so that it can serve for stable control operation for such as long as 20 to 30 charges of the molten metal. Further, even if the nozzle diameter is gradually enlarged due to the molten loss at the nozzle portion, it can be easily compensated in the manner that the amount of the molten loss is measured before work and according thereto, the nozzle diameter is changed with the nozzle diameter selector switch. This method is effective for a desired control operation. Further, the present invention has a metallurgical advantage in that the molten metal pouring rate is so invariable that the quality of the casting can be considerably improved.

As can be seen from the above-mentioned control and metallurgical advantages, the present invention provides remarkable merits and features in the continuous casting equipment.

We claim:

1. A method for controlling the pouring of molten metal from a tundish to a mold in a continuous casting process, comprising the steps of:

pouring said molten metal from a tundish nozzle having a variable slidable opening;

measuring the level of the molten metal in said mold;

comparing the level of the molten metal with a desired preset level in said mold;

varying the opening of said tundish nozzle in accordance with the difference between the measured level of the metal and said preset level in said mold;

detecting said tundish nozzle opening and providing an electrical signal representative thereof, and including providing said electrical signal with a component representing a desired minimum opening of said tundish nozzle to prevent the full closing thereof; and providing said electrical signal to the input of a servo amplifier along with the difference between the measured level of molten metal and said preset level in said mold to provide a control signal for varying said tundish nozzle opening.

2. A method as in claim 1 wherein said tundish nozzle opening is controlled by a servo-cylinder and said step of detecting and providing said electrical signal is performed by a work cylinder connected to said servo cylinder and a potentiometer having a center tap connected to the movable piston of said servo cylinder, whereby said electrical signal is taken from said center tap and an end terminal of said potentiometer.

3. A method as in claim 2 further comprising the step of selecting a conversion function representing different openings of said tundish nozzle with respect to the stroke of the piston of said servo-cylinder for modifying said electrical signal.

4. Apparatus for controlling the pouring of molten metal from a tundish to a mold in a continuous casting process, comprising:

means for pouring said molten metal from said tundish and including a nozzle having a variable opening;

means for measuring the level of the molten metal in said mold;

means for comparing the level of the molten metal with a desired preset level;

means for varying said tundish nozzle opening in accordance with the difference between said measured level of the metal and said preset level in said mold;

means for detecting said tundish nozzle opening and providing an electrical signal representative thereof, and including means for generating a component of said electrical signal representing a desired minimum opening of said tundish nozzle to prevent the full closing thereof; and means for amplifying said electrical signal and the difference between the measured level of molten metal and said preset level to provide a control signal for varying said tundish nozzle opening.

5. Apparatus as in claim 4 wherein said means for varying said tundish nozzle opening is a servo-cylinder, and said means for detecting further includes a work cylinder connected to said servo-cylinder and a potentiometer having a center tap connected to the movable piston of said servo-cylinder whereby said electrical signal is taken from said center tap and an end terminal of said potentiometer.

6. Apparatus as in claim 5 further comprising means for selecting a conversion function representing different openings of said tundish nozzle with respect to the stroke of the piston of said servo-cylinder for modifying said electrical signal.

* * * * *